United States Patent [19]

Jensen

[11] 4,250,583

[45] Feb. 17, 1981

[54] COLLAPSIBLE BOAT

[76] Inventor: Ragnar A. Jensen, Kirkeveien 29, Oslo 2, Norway

[21] Appl. No.: 22,466

[22] Filed: Mar. 21, 1979

[30] Foreign Application Priority Data

Mar. 22, 1978 [NO] Norway ..... 781021

[51] Int. Cl.[3] ..... B63B 7/06

[52] U.S. Cl. ..... 9/2 C; 135/4 R; 9/2 F

[58] Field of Search ..... 9/2 R, 2 C, 2 F, 2 S, 9/6.5; 135/4 R, 7.1 R

[56] References Cited

U.S. PATENT DOCUMENTS

| | | | |
|---|---|---|---|
| 2,545,084 | 3/1951 | Harasty | 9/2 C |
| 4,077,418 | 3/1978 | Cohen | 135/4 R |
| 4,124,910 | 11/1978 | Raymond | 9/2 C |

FOREIGN PATENT DOCUMENTS

| | | | |
|---|---|---|---|
| 6514972 | 5/1967 | Netherlands | 9/2 C |

*Primary Examiner*—Sherman D. Basinger

*Attorney, Agent, or Firm*—Watson, Cole, Grindle & Watson

[57] ABSTRACT

A collapsible boat includes a skeleton and an impervious skin tensioned about the skeleton. The skeleton includes a plurality of longitudinal and transverse frame members forming stringers and formers, the frame members being attached to the gunwale frame of the boat and the transverse members being turnable relative to the gunwale frame. The flexible skin is permanently attached to the gunwale frame and the longitudinal frame members are hinge connected to the gunwale frame at front and rear portions thereof. The longitudinal members are turnable relative to the gunwale frame in a direction transversely of the boat, and the longitudinal frame members along their horizontal portion each being provided with one or more hinge members turnable through an angle of 180°.

4 Claims, 7 Drawing Figures

COLLAPSIBLE BOAT

The present invention relates to a collapsible boat comprising a skeleton and a skin, impervious to water, in tension about the skeleton, the skeleton including a plurality of longitudinal and transverse frame members, said frame members being attached to the gunwale frame of the boat and said transverse frame members being turnable. The said skeleton formed by the longitudinal frame members forming the stringers of the boat and the transverse frame members forming the formers of the boat may be made from aluminium tubes and the said skin may be made from a reinforced glass fiber material or other suitable material.

The object of the invention is in particular to provide a boat having an extremely low weight relative to its size, said boat being collapsible in a manner enabling anyone in a matter of a few minutes to unfold or fold it, and which in its folded state occupies very little space. Thus it is convenient to e.g. store it in small closets. Further it is convenient to transport in a car, bus or in a sports plane or on the back.

Contrary to prior art collapsible boats the present boat is constructed so that the skin remains connected to the skeleton exteriorly thereof when said skeleton is folded together. Simultaneously the skeleton is interconnected so that there are no loose parts, said features making the boat simple and quick to unfold and fold.

The characterizing features of the invention will appear from the claims as well as the following description with reference to the accompanying drawing of a preferred embodiment of the invention. It will however be understood that the invention is explained by way of example and may thus be modified in a number of ways within the scope of the invention as defined by the claims.

Figure 1:
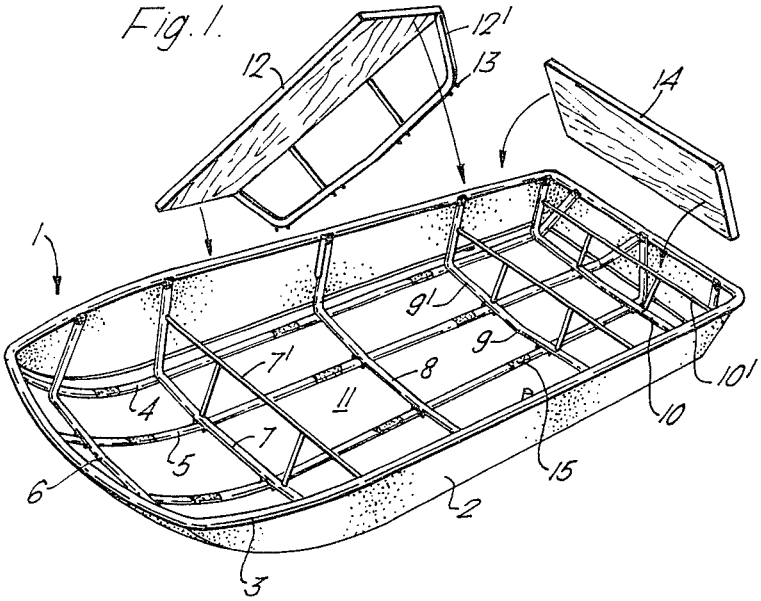
FIG. 1 is a perspective and expanded view of the boat according to the invention having a skin, skeleton and seats.

By way of example, the boat in FIG. 1 has a gunwale frame 3, a skeleton made from two pairs of stringers 4,5 and five formers 6,7,8,9 and 10. The formers 7,9 and 10 may be provided with stays 7', 9' and 10', respectively. Said stays provide additional stiffness to the boat as well as support of seats 12 and 14, respectively. The seat 12 is suitably provided with a frame member 12' intended to engage the stringers of the boat. In order to provide stability the said frame member 12' may be provided with a pair of short protruding elements 13 extending on either side of each stringer. The said formers may likewise be provided with such protruding elements 13 in order to better retain the stringers in their desired position when the boat is in its unfolded state. A skin 2 of waterproof material is arranged about the skeleton as shown in FIG. 1. The skin is permanently attached to the gunwale frame 3, e.g. by sewing, welding or riveting. The skin is suitably made from a glass fiber reinforced material or any suitable material, e.g. polyester material reinforced with polyamide and laminated with polyvinyl chloride or a combination of polyvinyl chloride reinforced with polyester threads and polyvinyl chloride reinforced with polyamide. It is however understood that the choice of material of the skin would be obvious to a person with ordinary skill in the art. A soft closed cell foam plastic mat 11 underlays the stringers against the surface of the skin forming the bottom floor of the boat. The said mat 11 primarily ensures a minimum boyancy of the boat in case it is filled with water. In addition it provides added protection of the skin in the bottom of the boat against wear caused by e.g. shoes used by boat occupants.

Figure 2:
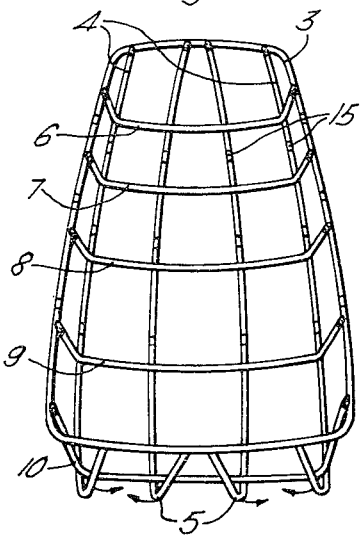
FIG. 2 illustrates the skeleton of the boat in its unfolded state.
Figure 3:
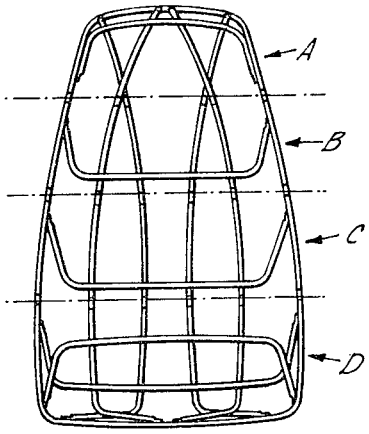
FIG. 3 is the skeleton of FIG. 2 in its folded state.

As will appear from FIGS. 2 and 3 the boat has been shown in the form of a skeleton only in order to simplify the explanation of how the boat is folded or unfolded. It is however understood that the skin is always permanently attached to the gunwale frame 3. As will appear from FIGS. 2 and 3 each of the stringers 4,5 and the longitudinal parts of the gunwale frame 3 are each provided with three hinge members 15. In the example shown there are a total of eighteen hinge members. Each hinge member 15 is capable of turning through an angle of 180° in one plane. As seen from FIG. 3 the hinge members 15 are aligned in three sets of six hinge members each and only in the folded state of the skeleton as shown in FIG. 3 are the said sets turnable about their common axis, respectively. Thus in the unfolded state in FIG. 2, it is not possible to operate the hinges 15, since each set of hinges 15 does not have a common axis as in the folded state of FIG. 3.

Figure 4:
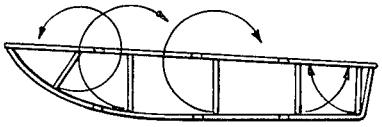
FIG. 4 illustrates the manner in which formers are folded.
Figure 5:
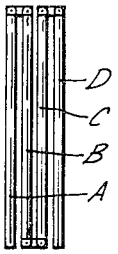
FIG. 5 illustrates schematically the folding of the sections of the skeleton of FIG. 3.

In order to fold the boat, the formers 6,7,8,9 and 10 are brought out of engagement with the stringers 4 and 5 by turning said formers as shown in FIG. 4, to bring them into a plane common with that of the gunwale frame. Thereafter the stringers are turned transversely of the boat, the stringers 5 towards the exterior of the boat and the stringers 4 towards the interior of the boat, as indicated by arrows at the bottom of FIG. 2. The stringers 4,5 will then lie in a plane substantially in alignment with that through the gunwale frame 3, and the skeleton will now be in its first folded state as shown in FIG. 3. The sections A,B and C,D are turned upwardly about the center set of hinges members and then the sections A and D are turned downwardly about the front and rear sets of hinge members, respectively. Thus the configuration of sections as shown schematically in Figure will appear.

Figure 7:
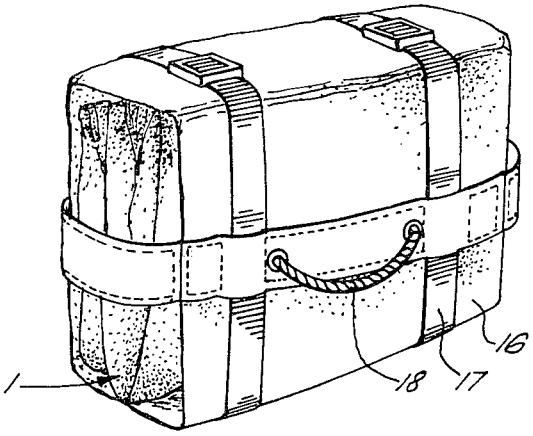
FIG. 7 is a perspective view of the boat in its folded state and made ready for taking away.

FIG. 7 illustrates the collapsible boat in its folded state as a take-away package. A piece of material 16 is arranged around the boat and straps 17 are provided. A handle 18 is also provided for carrying the boat in its folded state. In a preferred, but non-limiting embodiment the package of FIG. 7 has a length of 110 cm, a width of 35 cm and height of 80 cm.

Figure 6:
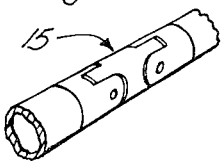
FIG. 6 is a hinge member for use in the skeleton.

It will of course be understood that the positioning of the hinge members is not limited to that shown in the Figures, but may be modified as necessary. The number of stringers and formers is not limited to the number as shown. The hinge members may have any other suitable form than that shown in FIG. 6 and could be a hinge which may be locked by a sleeve.

As seen from FIGS. 1, 2 and 3, the stringers 4,5 are connected to the front and rear postions of the gunwale frame in a turnable fashion, whereas the formers are connected to the gunwale frame at the longitudinal portions thereof in a turnable fashion. How said stringers and said formers may be connected to the gunwale frame would be obvious to a man with ordinary skill in the art.

I claim:

1. A collapsible boat comprising a skeleton and a skin, impervious to water, in tension about the skeleton, said skeleton including a plurality of longitudinal and transverse frame members forming the stringers and formers of said skeleton, said frame members being attached to the gunwale frame of the boat and said transverse frame members being turnable relative to said gunwale frame, characterized in that the skin, which is made of a flexible material, is permanently attached to the gunwale frame and that the longitudinal frame members are hinge connected to the gunwale frame at front and rear portions thereof, said longitudinal frame members being turnable relative to said gunwale frame in a direction transversely of the boat, said longitudinal frame members along their horizontal portion each being provided with at least one hinge member being turnable through an angle of 180 degrees.

2. A boat as claimed in claim 1, characterized in that the transverse frame members of the boat are hinged at starboard and port sides of the gunwale frame and are turnable in the longitudinal direction of the boat.

3. A boat as claimed in claim 1, characterized in that the starboard and port sides of the gunwale frame each are provided with at least one hinge member being turnable through an angle of 180 degrees.

4. A boat as claimed in claim 1 or 3, characterized in the hinge members being arranged in a coplanar set between neighbouring transverse frame members, and said set of hinge members being turnable about a horizontal transverse axis common of each set, when the longitudinal and transverse frame members have been turned into a plane substantially common with the gunwale frame.

* * * * *